United States Patent [19]

Kikuchi et al.

[11] 4,424,964

[45] Jan. 10, 1984

[54] PAPER TRANSPORTATION CONTROL SYSTEM

[75] Inventors: Yoshiki Kikuchi; Tomio Murayama, both of Ebina, Japan

[73] Assignee: Fuji Xerox Co., Ltd., Tokyo, Japan

[21] Appl. No.: 312,022

[22] Filed: Oct. 16, 1981

[30] Foreign Application Priority Data

Dec. 4, 1980 [JP] Japan ..... 55-170291

[51] Int. Cl.[3] ..... B65H 5/26; B65H 7/14

[52] U.S. Cl. ..... 271/91; 271/125; 271/265

[58] Field of Search ..... 271/9, 122, 125, 265

[56] References Cited

U.S. PATENT DOCUMENTS 4,204,668 5/1980 Yanagawa ..... 271/9

4,222,557 9/1980 Wu ..... 271/9 X 4,297,025 10/1981 Bach et al. ..... 271/9 X

FOREIGN PATENT DOCUMENTS 2315470 1/1977 France ..... 271/122

*Primary Examiner*—Robert B. Reeves

*Assistant Examiner*—David F. Hubbuch

*Attorney, Agent, or Firm*—Sughrue, Mion, Zinn, Macpeak, and Seas

[57] ABSTRACT

The retard roll in a paper transport mechanism is rotated by the feed roll to transport manually supplied paper when a photodetector indicates that manually supplied paper is present, the retard roll is substantially stationary and serves its normal purpose of preventing more than one sheet at a time from being transported by the feed roll as it rotates in an opposite direction.

1 Claim, 1 Drawing Figure

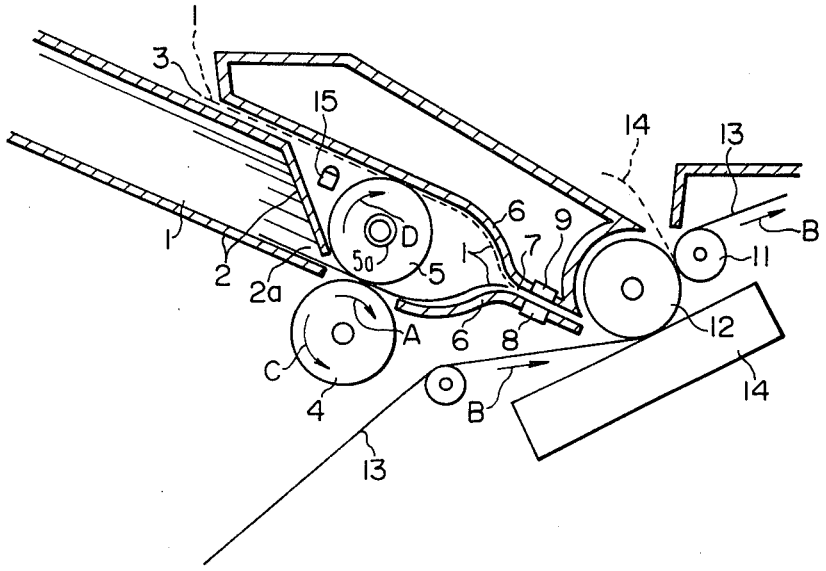
1
3
15
14
13
B
11
6
9
D
1
7
1
2
2a
5a
5
A
6
8
12
C
4
B
14
13

PAPER TRANSPORTATION CONTROL SYSTEM

BACKGROUND OF THE INVENTION

This invention relates to a system for controlling the transportation of paper used in a recording apparatus, such as a facsimile or a copying machine, and more particularly, to such a control system which permits selective supply of either paper from a paper tray or manually supplied paper.

There is a known paper transportation mechanism for a recording apparatus which automatically supplies regular paper one sheet after another from a paper tray but which also permits intruduction of paper manually if the use of different paper is desired, for example differently colored or sized paper. However, this transportation mechanism is complicated and requires complicated control for paper transportation, since a common feed roll is employed for selective delivery of either manually supplied paper or paper from the paper tray. Also, since the operator of the apparatus must actuate a switch for paper changeover, this erroneous operation may result in unnecessary recording.

SUMMARY OF THE INVENTION

In view of these circumstances, it is an object of this invention to provide a paper transportation control system which permits selective supply of two kinds of paper by a common feed roll without requiring any switch actuation by the operator. According to this invention, the aforesaid object is attained by employing a sensor which detects the presence of manually supplied paper, and a retard roll the rotation of which is controlled in response to the output of the sensor to transport manually supplied paper, while the retard roll also has its original function of paper separation.

BRIEF DESCRIPTION OF THE DRAWINGS

The invention will now be described in detail with reference to the single accompanying drawing which is a side elevational view of a heat transfer recording apparatus according to this invention.

DETAILED DESCRIPTION OF THE INVENTION

The drawing shows the essential components of the heat transfer recording apparatus embodying this invention. This apparatus includes a paper tray 2 from which cut paper 1 is automatically supplied, and a manual paper inlet 3 through which paper is manually supplied into the apparatus.

If the operator of the apparatus pushes a start button (not shown) without supplying any paper through the manual paper inlet 3, a feed roll 4 begins to rotate clockwise in the direction of an arrow A. The feed roll 4 and a retard roll 5 are positioned opposite to each other in the vicinity of the paper outlet 2*a* of the paper tray 2. The retard roll 5 is in contact with the feed roll 4, but a one-way clutch 5*a* prevents rotation of the retard roll 5 when the feed roll 4 is rotating clockwise.

If sheets of paper at the bottom of the stack of paper 1 in the paper tray 2 are delivered out of the paper outlet 2*a* by means of a feed mechanism (not shown), only one of them is fed between the feed roll 4 and the retard roll 5 by virtue of the function of the retard roll 5. Then, the paper 1 is guided along a guide plate 6, and passes through a narrowed path 7, as shown by a solid line. A light emitting element 8 and a light receiving element 9 are positioned on the opposite sides of the path 7, and detect the leading edge of the paper 1. After the lapse of a predetermined short time, a drive roll 11 begins rotation, and a back roll 12 is driven thereby, whereby an ink donor sheet 13 having one surface coated with a hot-melt solid ink begins to travel in the direction of an arrow B.

The paper 1 joins the ink donor sheet 13 when the former has passed through the path 7. The paper 1 is sandwiched between the back roll 12 and the ink donor sheet 13, and passes along the top of a thermal head 14 in which a heater is provided. The thermal head 14 selectively supplies heat to the ink donor sheet 13 in accordance with pictorial information, whereby molten ink is transferred onto the paper for recording information thereon.

The paper having information recorded thereon continues to be sandwiched between the back roll 12 and the ink donor sheet 13, and is transported with the ink donor sheet 13 until it is separated from the ink donor sheet 13 when the latter makes a sharp turn about the drive roll 11. Then, the paper is discharged from the apparatus along a path shown by a broken line 14.

If the operator supplies paper through the manual paper inlet 3, and pushes the start button, a photocoupler 15 provided between the manual paper inlet 3 and the retard roll 5 detects the presence of manually supplied paper 1 (broken line). In response thereto, the feed roll 4 begins to rotate counterclockwise or in the direction of an arrow C. The retard roll 5 is thereby driven, and begins to rotate clockwise or in the direction of an arrow D.

The retard roll 5 is in contact with a guide 6 positioned thereabove, and maintains a predetermined amount of pressure therebetween. Thus, if the retard roll 5 starts rotation in the direction of the arrow D, the paper 1 is guided along the broken line by the guide 6, and fed forward into the path 7. The manually supplied paper is thereafter transported in the same manner as the paper from the paper tray 2, and no description of the subsequently operation is necessary.

As is obvious from the foregoing description, this invention enables the operator of the apparatus to change over paper without taking any other trouble than furnishing paper. Moreover, the apparatus of this invention is inexpensive, and compact in construction, since the retard roll is utilized for transporting manually supplied paper.

What is claimed is:

1. A paper transportation control system for a recording apparatus comprising first passage means for receiving paper from a paper tray, second passage means substantially parallel to said first passage means for receiving manually supplied paper, a retard roll rotatably mounted intermediate said first and second passages in contact with said second passage means, one-way clutch means permitting rotation of said retard roll in a direction to feed a manually supplied sheet of paper between said retard roll and said second passage means, a feed roll located on the opposite side of said first passage means from said retard roll in contact with said retard roll, driving means for rotating said feed roll in opposite directions whereby upon operation of said feed roll in one direction, said retard roll will be rotated to feed a manually supplied sheet of paper and on rotation of said feed roll in the opposite direction, a sheet of paper will be fed from a paper tray between said feed roll and said retard roll, with said retard roll being maintained stationary and sensing means locating in said second passage means in advance of said retard roll for sensing a sheet of manually supplied paper and providing a control signal to said driving means to rotate said feed roll and said retard roll to feed said manually supplied sheet of paper.

* * * * *